US010283874B2

(12) United States Patent
Tsuchiya et al.

(10) Patent No.: US 10,283,874 B2
(45) Date of Patent: May 7, 2019

(54) ANTENNA APPARATUS

(71) Applicant: FUJITSU TEN LIMITED, Kobe-shi, Hyogo (JP)

(72) Inventors: Junzoh Tsuchiya, Kobe (JP); Kenji Oka, Kobe (JP); Ryuichi Hashimoto, Kobe (JP); Norihisa Nishimoto, Kobe (JP); Kenta Shirahige, Kobe (JP)

(73) Assignee: FUJITSU TEN LIMITED, Kobe-shi (JP)

( * ) Notice: Subject to any disclaimer, the term of this patent is extended or adjusted under 35 U.S.C. 154(b) by 22 days.

(21) Appl. No.: 15/697,816

(22) Filed: Sep. 7, 2017

(65) Prior Publication Data

US 2018/0115084 A1 Apr. 26, 2018

(30) Foreign Application Priority Data

Oct. 25, 2016 (JP) ..... 2016-208629

(51) Int. Cl.

| | |
|---|---|
| ***H01Q 21/06*** | (2006.01) |
| ***H01Q 19/02*** | (2006.01) |
| ***H01Q 13/20*** | (2006.01) |
| ***H01Q 21/00*** | (2006.01) |
| *H01Q 3/26* | (2006.01) |

(52) U.S. Cl.

CPC ..... *H01Q 19/021* (2013.01); *H01Q 13/206* (2013.01); *H01Q 21/0075* (2013.01); *H01Q 21/065* (2013.01); *H01Q 3/26* (2013.01)

(58) Field of Classification Search

CPC ..... H01Q 19/021; H01Q 3/26; H01Q 13/206; H01Q 21/0075; H01Q 21/065

See application file for complete search history.

(56) References Cited

U.S. PATENT DOCUMENTS

2014/0368396 A1* 12/2014 Shinkai ..... H01Q 1/38 343/817

FOREIGN PATENT DOCUMENTS

| | | |
|---|---|---|
| JP | 2008-304417 A | 12/2008 |
| JP | 2009-111463 A | 5/2009 |

* cited by examiner

*Primary Examiner* — Hoang V Nguyen

(74) *Attorney, Agent, or Firm* — Oliff PLC

(57) ABSTRACT

An antenna apparatus includes: an antenna array that: i) includes a plurality of antennas arranged next to each other in a predetermined direction, ii) is supplied with power from a power source, and iii) transmits radio waves; and a plurality of dummy antennas that: i) are provided on opposite sides of the antenna array in the predetermined direction, ii) are supplied with power from an electric field leaked from the antennas of the antenna array, and iii) transmit radio waves. Thus, it is possible to prevent an accuracy of detecting a target from deteriorating.

16 Claims, 16 Drawing Sheets

ANTENNA APPARATUS

BACKGROUND OF THE INVENTION

Field of the Invention

The invention relates to an antenna apparatus.

Description of the Background Art

Conventionally, an antenna apparatus that is installed, for example, on a radar apparatus, includes an antenna array having a plurality of antennas arranged in a predetermined direction. If the plurality of antennas are provided in line, there is a case in which a predetermined radiation pattern cannot be obtained because radio waves from those antennas combine together. Therefore, a conventional antenna apparatus includes a choke between antennas to secure isolation between those antennas, such that the predetermined radiation pattern can be obtained.

Since the choke is added, a greater distance is needed between those antennas of the conventional antenna apparatus. However, there is a possibility that, for example, target detection accuracy of the receiving antenna apparatus that is used for the radar apparatus may be reduced by an influence of a phase return caused by the greater distance between the antennas. Therefore, it has been desired to shorten the distance between the antennas of the antenna apparatus.

SUMMARY OF THE INVENTION

According to one aspect of the invention, an antenna apparatus includes: an antenna array that: i) includes a plurality of antennas arranged next to each other in a predetermined direction, ii) is supplied with power from a power source, and iii) transmits radio waves; and a plurality of dummy antennas that: i) are provided on opposite sides of the antenna array in the predetermined direction, ii) are supplied with power from an electric field leaked from the antennas of the antenna array, and iii) transmit radio waves.

Thus, an arrangement distance between antennas can be smaller, and it is possible to prevent an accuracy of detecting a target from deteriorating due to a wide distance between the antennas.

According to another aspect of the invention, the antenna apparatus further includes a plurality of matching elements each of which is connected to an end of each of the plurality of dummy antennas.

Thus, radiation patterns of the dummy antennas are substantially identical to radiation patterns of the antennas. Thus, it is possible to reduce a distortion of a radiation pattern of the antenna apparatus.

Therefore, an object of the invention is to provide an antenna apparatus in which antennas are provided at intervals of a smaller distance.

These and other objects, features, aspects and advantages of the invention will become more apparent from the following detailed description of the invention when taken in conjunction with the accompanying drawings.

DESCRIPTION OF THE EMBODIMENTS

An antenna apparatus of this embodiment will be described in detail with reference to the drawings. The embodiment below does not intend to limit the invention.

[1. Antenna Apparatus]

Figure 1:
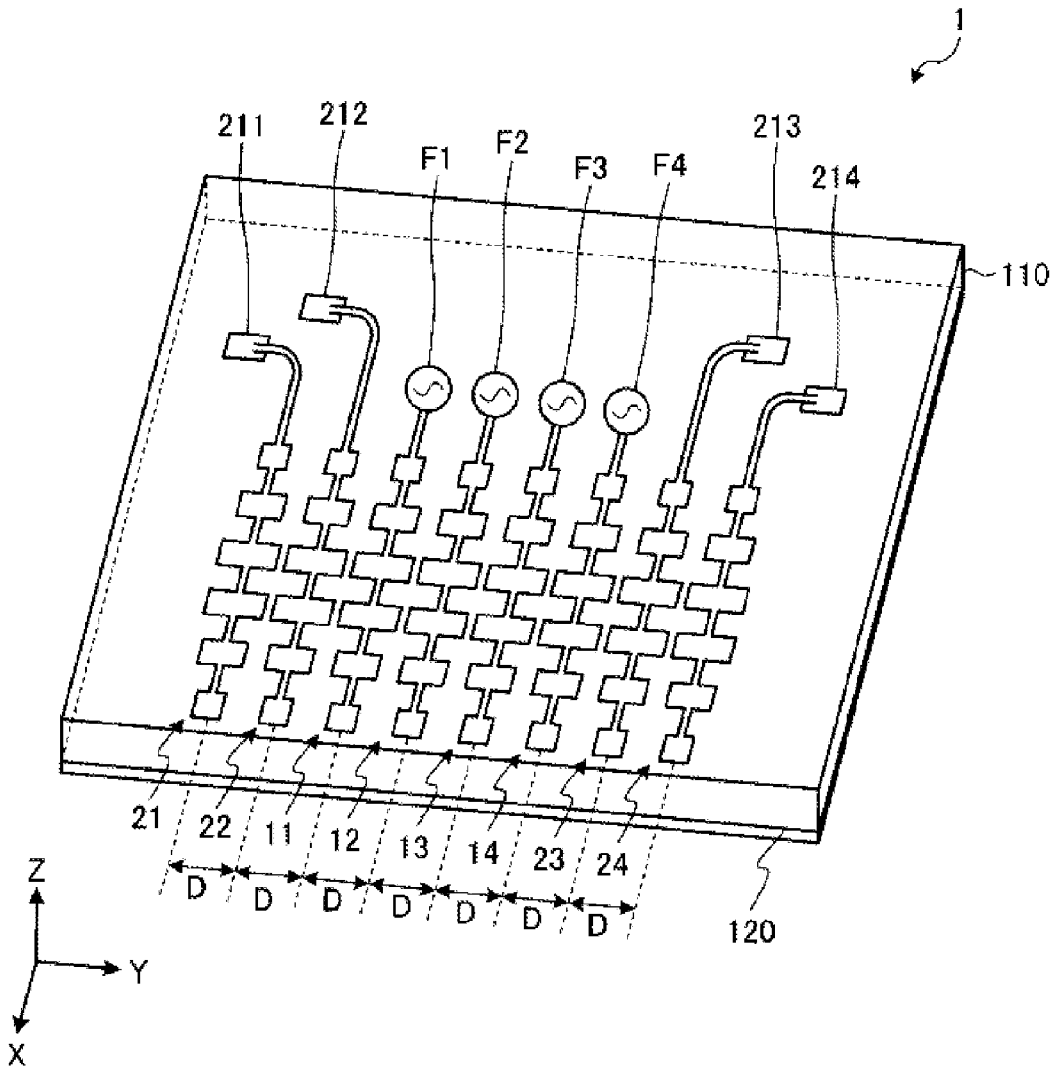
FIG. 1 illustrates a perspective view of an antenna apparatus of an embodiment.

FIG. 1 illustrates a perspective view of an antenna apparatus 1 of this embodiment. For easy understanding, FIG. 1 includes three-dimensional Cartesian coordinates defined by an X-axis direction, a Y-axis direction and a Z-axis direction that are orthogonal to one another. The Cartesian coordinates are included in some of the drawings that will be used later for explanation.

The antenna apparatus 1 in FIG. 1 includes a dielectric substrate 110, a plurality of antennas 11-14, a plurality of dummy antennas 21-24, and a plurality of matching elements 211-214.

[Dielectric Substrate]

The dielectric substrate 110 is a substrate having a predetermined relative permittivity. As shown in FIG. 1, the dielectric substrate 110 is, for example, a rectangular substrate. It is recommended that the dielectric substrate 110 should be made of, for example, fluoropolymer resin, such as poly-tetra-fluoro-ethylene (PTFE), or liquid crystal polymer (LCP).

A ground 120 is provided to one surface of the dielectric substrate 110. The ground 120 is formed as a thin-film conductive pattern. A thin film, such as a copper thin film, is formed all over the dielectric substrate 110 by use of, for example, a sputtering method or a deposition method, and then the thin-film pattern is formed by patterning the thin film by use of, for example, a photo-etching method. The thin-film pattern may be formed as a pattern on a thin-film substrate, a thick-film substrate or a copper-film substrate.

[Antenna]

The plurality of antennas 11-14 are arranged next to each other in line in a predetermined direction (the Y-axis direction in FIG. 1). The plurality of antennas 11-14 will be collectively described also as an antenna array 10. The plurality of antennas 11-14 are provided at intervals of an arrangement distance D on a surface facing to a surface to which the ground 120 of the dielectric substrate 110 is provided. The arrangement distance D is, for example, equal to or smaller than one wavelength of a resonance frequency of the plurality of antennas 11-14. As described above, the plurality of antennas 11-14 are arranged at small intervals.

Each of the plurality of antennas 11-14 is formed as a thin-film conductive pattern. The thin film, such as a thin copper film, is formed all over the dielectric substrate 110 by use of, for example, a sputtering method or a deposition method, and then the thin-film pattern is formed by patterning the thin film by use of, for example, a photo-etching method.

The plurality of antennas 11-14 send signals input from, for example, a radio device, not illustrated, through feeding points F1-F4, or the plurality of antennas 11-14 output reception radio waves to, for example, the radio device, not illustrated, through the feeding points F1-F4.

A shape of the plurality of antennas 11-14 is identical to a shape of the plurality of dummy antennas 21-24. The shape will be described later with reference to FIG. 2.

[Dummy Antenna]

The plurality of dummy antennas 21-24 are provided on a surface on which the antenna array 10 of the dielectric substrate 110 is provided. The plurality of dummy antennas 21-24 are provided on opposite sides of the antenna array 10. In an example shown in FIG. 1, the dummy antennas 21 and 22 are provided in a negative Y-axis direction of the antenna array 10. Moreover, the dummy antennas 23 and 24 are provided in a positive Y-axis direction of the antenna array 10. The dummy antennas 21-24 are provided at intervals identical to the intervals of the arrangement distance D at which the plurality of antennas 11-14 are provided.

As described above, since the dummy antennas 21-24 are provided at intervals identical to the intervals of the arrangement distance D at which the plurality of antennas 11-14 are provided, radio waves transmitted from the plurality of dummy antennas 21-24 can combine in an identical manner to radio waves transmitted from the plurality of antennas 11-14 combine. Thus, radiation patterns of the dummy antennas 21-24 are similar to radiation patterns of the antennas 11-14, and symmetry of a radiation pattern of the antenna apparatus 1 can be ensured. This point will be described later with reference to FIGS. 3A-4C. Here, the term "combine" means: An electric field leaked from a radiation antenna transmitting radio waves affects a neighboring non-radiation antenna so that the affected non-radiation antenna transmits the radio waves; thus, the radio waves transmitted from those antennas combine with each other. In this case, a radiation pattern of the radiation antenna is not symmetrical.

Like the plurality of antennas 11-14, each of the plurality of dummy antennas 21-24 is formed as a thin-film conductive pattern. The thin film, such as a thin copper film, is formed all over the dielectric substrate 110 by use of, for example, a sputtering method or a deposition method, and then the thin-film pattern is formed by patterning the thin film by use of, for example, a photo-etching method. The thin-film pattern may be formed as a pattern on a thin-film substrate, a thick-film substrate or a copper-film substrate.

The plurality of dummy antennas 21-24 include no feeding point, and are not connected to, for example, the radio device, not illustrated. As described above, the plurality of dummy antennas 21-24 are parasitic antennas. The plurality of dummy antennas 21-24 combine with the antennas 11-14, and transmit or receive the radio waves. The combining of the antennas will be described later with reference to FIGS. 3A-4C.

The plurality of dummy antennas 21-24 are formed in a shape identical to the shape of the antennas 11-14. Here, the shape of the plurality of antennas 11-14 and the plurality of dummy antennas 21-24 will be described with reference to FIG. 2.

Figure 2:
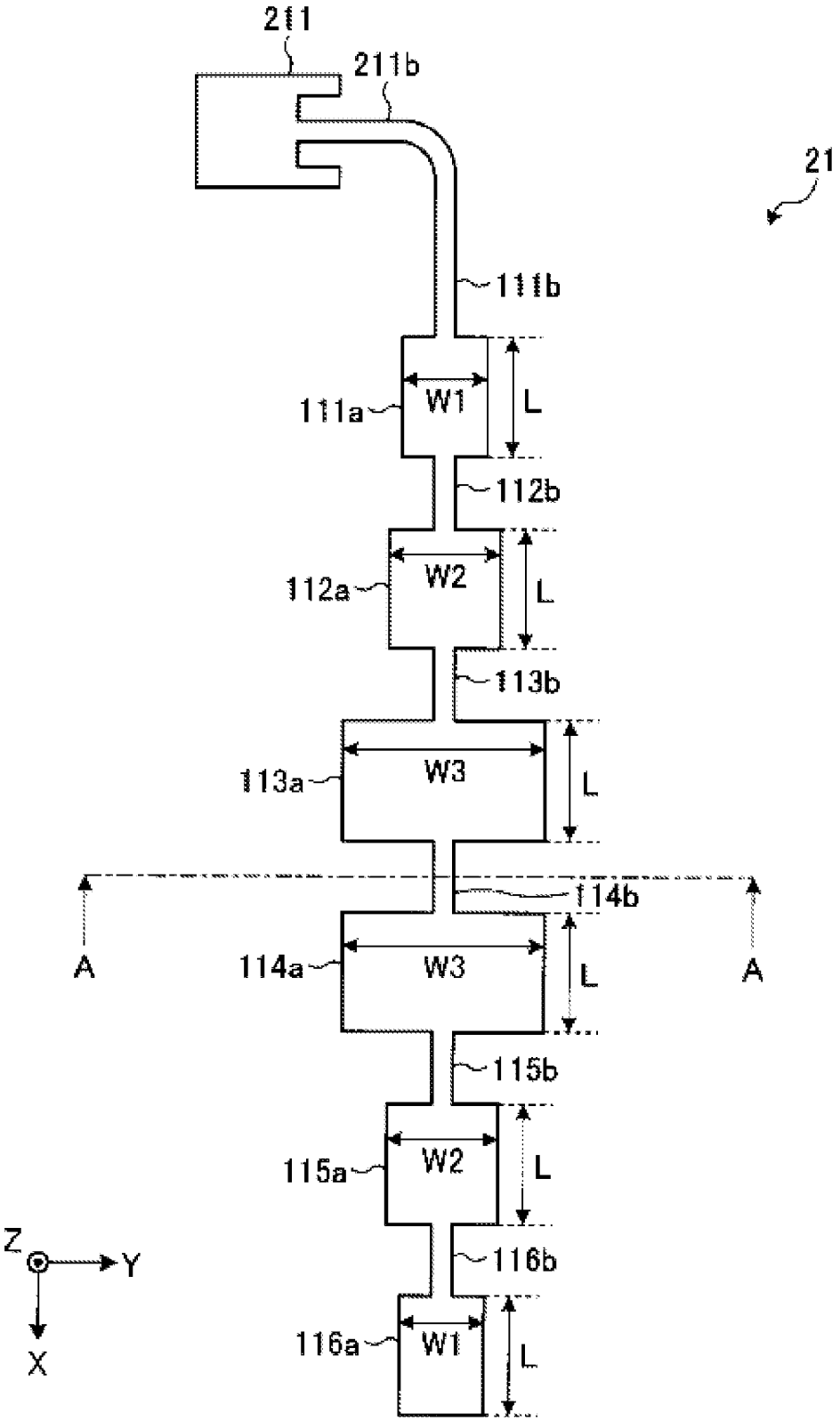
FIG. 2 illustrates a shape of a dummy antenna.

As described above, since the shape of the plurality of dummy antennas 21-24 is identical to the shape of the plurality of antennas 11-14, the shape of the dummy antenna 21 will be here described. FIG. 2 illustrates the shape of the dummy antenna 21.

As shown in FIG. 2, the dummy antenna 21 includes a plurality of patch elements 111*a*-116*a* and a plurality of conductor lines 111*b*-116*b*.

Each of the plurality of patch elements 111*a*-116*a* is formed as a thin-film conductive pattern. However, the patch elements do not necessarily have to be thin-film patterns. The plurality of patch elements 111*a*-116*a* are rectangular. The patch elements 111*a*-116*a* are provided in one line in the X-axis direction. The dummy antenna 21 transmits or receives linearly polarized waves in the X-axis direction (hereinafter referred to as "vertically polarized waves").

The patch elements 111*a* and 116*a* have a length L and a width W1. The patch elements 112*a* and 115*a* have the length L and a width W2. The patch elements 113*a* and 114*a* have the length L and a width W3. In other words, the patch elements 111*a*-116*a* are provided axisymmetrically with respect to a line A in FIG. 2.

The patch elements 111*a*-116*a* transmit or receive the radio waves of a resonance frequency according to the length L. Moreover, the patch elements 111*a*-116*a* transmit or receive the radio waves of electric field strengths according to the width W1, W2 and W3. In the example in FIG. 2, the patch elements 113*a* and 114*a* transmit or receive signals having a greatest strength. Thus, the radiation pattern of the dummy antenna 21 has a great electric field strength around the line A.

Each of the conductor lines 111*b*-116*b* is formed as a thin-film conductive pattern. However, the pattern does not necessarily have to be a thin-film pattern. The conductor lines 111*b*-116*b* are so-called microstrip lines. One end of the conductor line 111*b* is connected to the patch element 111*a*. One end of the conductor line 112*b* is connected to the patch element 112*a*, and another end of the conductor line 112*b* is connected to the patch element 111*a*.

One end of the conductor line 113*b* is connected to the patch element 113*a*, and another end of the conductor line 113*b* is connected to the patch element 112*a*. One end of the conductor line 114*b* is connected to the patch element 114*a*, and another end of the conductor line 114*b* is connected to the patch element 113*a*. One end of the conductor line 115*b* is connected to the patch element 115*a*, and another end of the conductor line 115*b* is connected to the patch element 114*a*. One end of the conductor line 116*b* is connected to the patch element 116*a*, and another end of the conductor line 116*b* is connected to the patch element 115*a*.

Another ends of the conductor lines 111*b* of the antennas 11-14 are connected to the feeding points F1-F4, respectively. Thus, the conductor lines 111*b*-116*b* of the antennas 11-14 can be regarded as feeding lines.

As described above, the plurality of patch elements 111*a*-116*a* and the plurality of conductor lines 111*b*-116*b* are formed to transmit or receive the radio waves of a predetermined resonance frequency in a predetermined radiation pattern.

A case in which a number of the plurality of patch elements 111*a*-116*a* is six is described above. However, the number of the patch elements is not limited to six. The number of the patch elements may be greater or smaller than six. Moreover, the shape of the patch elements 111*a*-116*a* is not limited to the rectangular shape. The patch elements 111*a*-116*a* may be a square, a polygon, or a circle. Moreover, the patch elements 111*a*-116*a* do not necessarily have to be axisymmetrically arranged with respect to the line A in FIG. 2. The patch elements may be arranged in a form other than axisymmetry. Moreover, the polarized waves of the antennas are not limited to the vertical polarized waves, but may be another type of polarized waves, e.g., horizontally polarized waves, 45-degree polarized waves, or circularly polarized waves.

The dummy antenna 21 includes the patch elements 111*a*-116*a* here, but elements that the dummy antenna 21 includes are not limited to patch elements. For example, the dummy antenna 21 may include a line antenna element.

As described above, the shape of the dummy antennas 21-24 is identical to the shape of the plurality of antennas 11-14 so that the radiation patterns of the dummy antennas 21-24 can be similar to the radiation patterns of the antennas 11-14. Thus, the symmetry of the radiation pattern of the antenna apparatus 1 can be improved. This point will be described later with reference to FIGS. 3A-4C.

[Matching Element]

With reference back to FIG. 1, the matching elements 211-214 are connected to the dummy antennas 21-24, respectively. The matching elements 211-214 are provided such that a load connection state of the dummy antennas 21-24 is identical to a load connection state of the antennas 11-14. The antennas 11-14 are connected to, for example, a radio device, not illustrated, and an input impedance of each of the plurality of antennas 11-14 is adjusted to approximately 50Ω.

On the other hand, the dummy antennas 21-24 are not connected to the radio device. Therefore, in a case where the dummy antennas 21-24 are not connected to the matching elements 211-214, respectively, the load connection state of the dummy antennas 21-24 is different from the load connection state of the antennas 11-14. As a result, although the shape of the dummy antennas 21-24 is identical to the shape of the antennas 11-14, the radiation patterns of the dummy antennas 21-24 are different from the radiation patterns of the antennas 11-14.

Therefore, as shown in FIG. 1, the matching elements 211-214 are connected to the dummy antennas 21-24. Thus, the load connection state of the dummy antennas 21-24 is substantially identical to the load connection state of the antennas 11-14. More specifically, an impedance that is substantially identical to the impedance value (e.g., 50Ω) of the load of the antennas 11-14 is given to the matching elements 211-214.

Thus, the radiation patterns of the dummy antennas 21-24 are substantially identical to the radiation patterns of the antennas 11-14. As a result, a distortion of the radiation pattern of the antenna apparatus 1 can be reduced, and also symmetry of the radiation patterns of the plurality of antennas 11-14 can be improved. This will be described later in detail with reference to FIGS. 3A-4C.

Each of the matching elements 211-214 is formed as a thin-film conductive pattern. However, the pattern does not necessarily have to be a thin-film pattern. The thin film, such as a thin copper film, is formed all over the dielectric substrate 110 by use of, for example, a sputtering method or a deposition method, and then, like the antennas 11-14 and the dummy antennas 21-24, the thin-film pattern is formed by patterning the thin film by use of, for example, a photo-etching method.

Therefore, the matching elements 211-214 can be formed at a same time at which the antennas 11-14 and/or the dummy antennas 21-24 are formed. Therefore, the matching elements 211-214 can be formed without increasing a production process.

Each of the matching elements 211-214 is formed in, for example, a rectangular shape having a concavity on one side. For example, as shown in FIG. 2, the matching element 211 is connected to one end of a conductor line 211*b* at the concavity. Another end of the conductor line 211*b* is connected to another end of the conductor line 111*b* of the dummy antenna 21.

Moreover, the conductor line 211*b* is arranged substantially orthogonal to the conductor lines 111*b* of the dummy antenna 21. In the example in FIG. 2, the conductor line 211*b* is provided along the Y-axis.

In a same manner as described above, the matching elements 212-214 are also connected to the dummy antennas 22-24, respectively, through the conductor line 211*b* provided along the Y-axis.

The dummy antennas 21-24 combine with the antennas 11-14, and thus a current flows to the dummy antennas 21-24. Then, the current flows also to the matching elements 211-214 through the conductor lines 211*b*. As described above, the matching elements 211-214 are formed as the thin-film conductive patterns, like the antennas 11-14. However, the pattern does not necessarily have to be a thin-film pattern. Once the current flows to the matching elements 211-214, radio waves are transmitted from the matching elements 211-214.

Here, the current flows to the matching elements 211-214 through the conductor lines 211*b* provided along the Y-axis. Therefore, the matching elements 211-214 transmit or receive linearly polarized waves in the Y-axis direction (hereinafter referred to as "horizontally polarized waves").

For example, in a case where the conductor lines 211*b*-214*b* are provided along the X-axis, the matching elements 211-214 transmit or receive the vertically polarized waves. The direction of the vertically polarized waves that the matching elements 211-214 transmit or receive is the same as a direction of the polarized waves that are transmitted or received by the dummy antennas 21-24. Therefore, the radiation patterns of the dummy antennas 21-24 are changed by an influence of the radiation from the matching elements 211-214. Thus, the radiation patterns of the dummy antennas 21-24 are different from the radiation patterns of the antennas 11-14.

On the other hand, the matching elements 211-214 of this embodiment transmit or receive the horizontally polarized waves. Therefore, the radiation by the matching elements 211-214 gives less influence on the dummy antennas 21-24 that transmit or receive the vertically polarized waves. Thus, the radiation patterns of the dummy antennas 21-24 can be similar to the radiation patterns of the antennas 11-14.

[2. Structure of the Antenna Apparatus]

Next described with reference to FIGS. 3A-4C will be a reason why the antenna apparatus 1 of this embodiment is configured to reduce a distortion of the radiation pattern. Here, for simple explanation, a case in which the antenna apparatus 1 includes the two fed antennas 11 and 12 and two parasite antennas of the dummy antennas 21 and 22 will be explained. The antenna apparatus 1 in FIG. 1 is configured to similarly reduce the distortion of the radiation pattern. Moreover, this explanation will describe a case in which the antenna apparatus 1 transmits signals, as an example. However, a similar explanation can be applied also to a case in which the antenna apparatus 1 receives signals.

[Without Dummy Antennas]

Figure 3A:
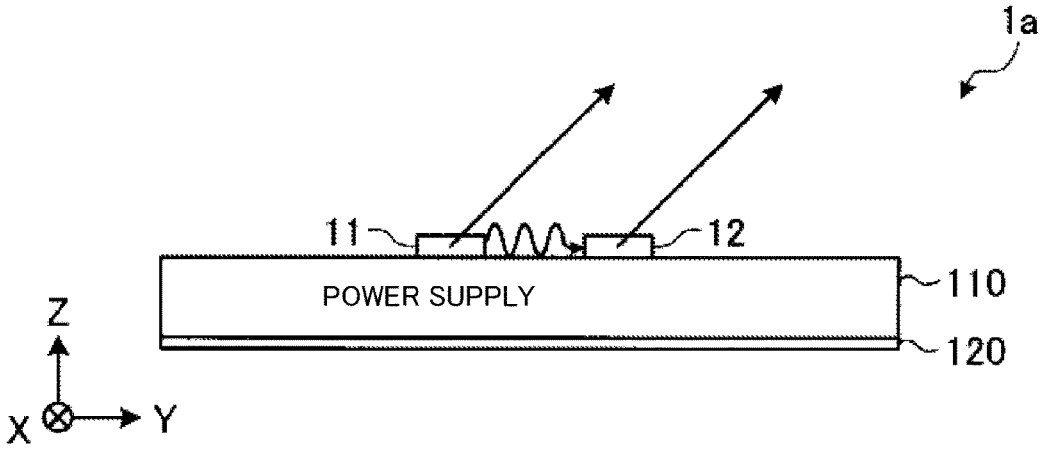
FIG. 3A illustrates a radiation pattern of an antenna apparatus.
Figure 3B:
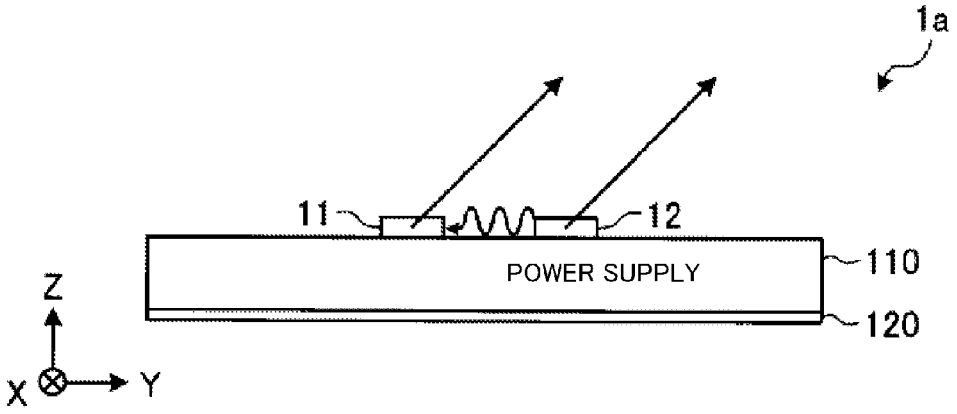
FIG. 3B illustrates a radiation pattern of the antenna apparatus.
Figure 3C:
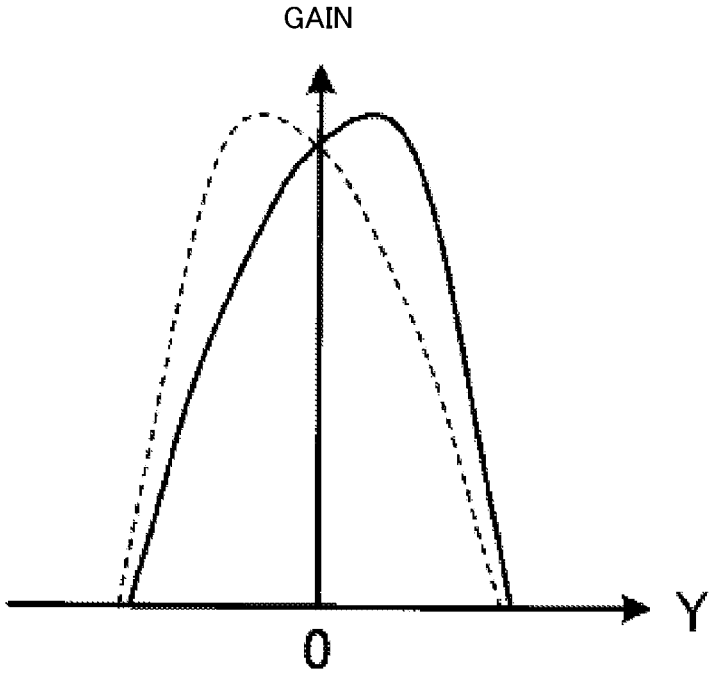
FIG. 3C illustrates a radiation pattern of the antenna apparatus.

First explained with reference to FIGS. 3A-3C will be a radiation pattern of an antenna apparatus 1*a* that does not include the dummy antennas 21 and 22. FIGS. 3A-3C illustrate the radiation patterns of the antenna apparatus 1*a*.

The antenna apparatus 1*a* shown in FIGS. 3A and 3B includes the two antennas 11 and 12, and the antenna apparatus 1*a* has a same structure as the structure of the antenna apparatus 1 shown in FIG. 1, except that the antenna apparatus 1*a* includes no dummy antennas 21-24.

First, as shown in FIG. 3A, in a case where power is supplied to the antenna 11, radio waves are transmitted from the antenna 11. Power is not supplied to the antenna 12, but the antenna 12 combines with the antenna 11 (i.e., the antenna 12 is supplied with power from an electric field leaked from the antenna 11) so that radio waves are also transmitted from the antenna 12.

Therefore, in a case where the power is supplied to the antenna 11, the radiation pattern of the antenna apparatus 1*a* is tilted toward a direction of the antenna 12, i.e., the positive Y-axis direction, as shown by a solid line in FIG. 3C.

Next, as shown in FIG. 3B, in a case where the power is supplied to the antenna 12, the radio waves are transmitted from the antenna 12. Power is not supplied to the antenna 11, but the antenna 11 combines with the antenna 12 so that the radio waves are also transmitted from the antenna 11.

Therefore, in the case where the power is supplied to the antenna 12, the radiation pattern of the antenna apparatus 1*a* is tilted toward a direction of the antenna 11, i.e., the negative Y-axis direction, as shown by a dotted line in FIG. 3C.

As described above, in a case where the dummy antennas 21 and 22 are not provided, the radiation pattern of the antenna apparatus 1*a* is distorted and is not symmetrical. Therefore, if a distance between the antennas 11 and 12 of the antenna apparatus 1*a* is small, the radiation pattern is not symmetrical because the antennas 11 and 12 combine with each other.

[With Dummy Antennas]

Figure 4A:
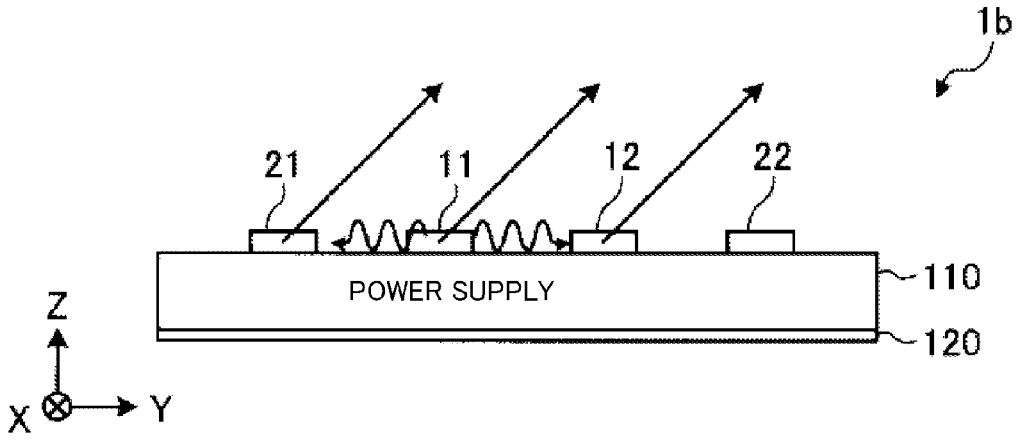
FIG. 4A illustrates a radiation pattern of an antenna apparatus.
Figure 4B:
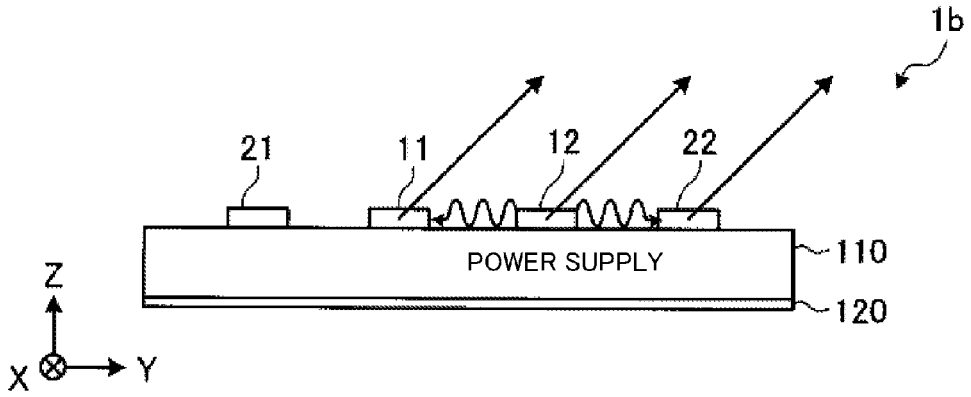
FIG. 4B illustrates a radiation pattern of the antenna apparatus.
Figure 4C:
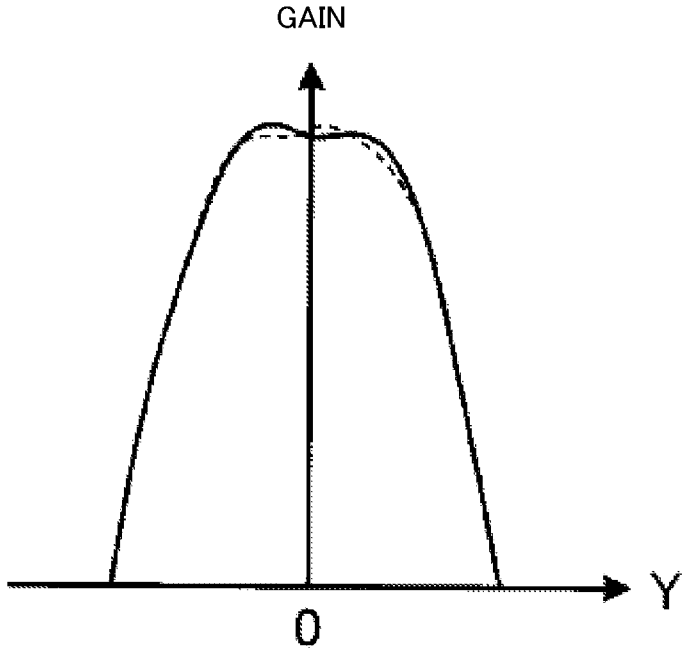
FIG. 4C illustrates a radiation pattern of the antenna apparatus.

Next, a radiation pattern of an antenna apparatus 1*b* including the dummy antennas 21 and 22 will be described with reference with FIGS. 4A-4C. FIGS. 4A-4C illustrate the radiation patterns of the antenna apparatus 1*b*.

The antenna apparatus 1*b* shown in FIGS. 4A and 4B includes the two antennas 11 and 12, and has a same structure as the antenna apparatus 1 shown in FIG. 1, except that the antenna apparatus 1*b* includes the dummy antennas 21 and 22, one of which is provided adjacent to the antenna 11 and the other is provided adjacent to the antenna 12.

First, in a case where the power is supplied to the antenna 11 as shown in FIG. 4A, radio waves are transmitted from the antenna 11. Moreover, radio waves are also similarly transmitted from the antenna 12. The antenna apparatus 1*b* includes the dummy antenna 21 provided adjacent to the antenna 11. Therefore, the dummy antenna 21 combines with the antenna 11. Thus, radio waves are transmitted also from the dummy antenna 21.

As described above, in a case where the power is supplied to the antenna 11, the radio waves are transmitted from the antenna 11 and also from both the antenna 12 and the dummy antenna 21 that are provided on opposite sides of the antenna 11. Therefore, the radiation pattern of the antenna 11 of the antenna apparatus 1*b* is symmetrical as shown by a solid line shown in FIG. 4C.

Next, in a case where the power is supplied to the antenna 12 as shown in FIG. 4B, the radio waves are transmitted from the antenna 12, and the radio waves are also transmitted from the antenna 11. Moreover, the dummy antenna 22 is provided adjacent to the antenna 12 in the antenna apparatus 1*b*. Therefore, the dummy antenna 22 combines with the antenna 12. Thus, the radio waves are also transmitted from the dummy antenna 22.

As described above, in the case where the power is supplied to the antenna 12, the radio waves are transmitted from the antenna 12 and also from both the antenna 11 and the dummy antenna 22 that are provided on the opposite sides of the antenna 12. Therefore, the radiation pattern of the antenna 12 of the antenna apparatus 1*b* is symmetrical as shown by a dotted line in FIG. 4C. The radiation pattern of the antenna 12 is substantially identical to the radiation pattern of the antenna 11.

As described above, in a case where the dummy antennas 21 and 22 are provided adjacent to the antenna 11 and the antenna 12, respectively, the radiation pattern can be highly symmetrical even in a case where the distance between the antennas 11 and 12 is small so that those antennas combine with each other. In other words, the distance between the antennas 11 and 12 can be small while ensuring a symmetry of the radiation pattern of the antenna apparatus 1*b*.

Moreover, as the radiation patterns transmitted from the antennas provided on opposite sides of an antenna (e.g., the antenna 11) to which the power is supplied are more similar to the radiation pattern transmitted from the power-supplied antenna, the symmetry of the radiation pattern of the antenna apparatus 1*b* can be ensured.

Therefore, the antenna apparatus 1 of this embodiment has the arrangement distance D between the dummy antennas 21-24 that is identical to the intervals of the arrangement distance D between the antennas 11-14, as described above. Thus, a combining state of the dummy antennas 21-24 is substantially identical to a combining state of the antennas 11-14. Thus, the radiation patterns of the radio waves transmitted from the antennas provided on the opposite sides of the power-supplied antenna (e.g., the antenna 11) are substantially identical to each other. Therefore, the symmetry of the radiation pattern of the antenna apparatus 1 can be improved.

Further, in the antenna apparatus 1 of this embodiment, as described above, the shape of the dummy antennas 21-24 is identical to the shape of the antennas 11-14. Thus, the radiation patterns of the dummy antennas 21-24 can be similar to the radiation patterns of the antennas 11-14, and thus the symmetry of the radiation pattern of the antenna apparatus 1 can be improved.

Moreover, the matching elements 211-214 are provided to the ends of the dummy antennas 21-24 of the antenna apparatus 1 of this embodiment. Thus, the load connection state of the dummy antennas 21-24 is identical to the load connection state of the antennas 11-14. Thus, the radiation patterns of the dummy antennas 21-24 can be similar to the radiation patterns of the antennas 11-14. Thus, the symmetry of the radiation pattern of the antenna apparatus 1 can be improved.

Moreover, the direction of the polarized waves transmitted from the matching elements 211-214 are substantially orthogonal to the direction of the polarized waves transmitted from the dummy antennas 21-24. Thus, the radio waves transmitted from the matching elements 211-214 have less influence on the dummy antennas 21-24 and the antennas 11-14.

As described above, in the antenna apparatus 1 of this embodiment, the shape and the arrangement distance D of the dummy antennas 21-24 are adjusted and the matching elements 211-214 are connected to the dummy antennas 21-24. Thus, the radiation patterns of the dummy antennas 21-24 are substantially identical to the radiation patterns of the antennas 11-14. Therefore, even in the case where the distance between the antennas 11-14 is small, the symmetry of the radiation pattern of the antenna apparatus 1 can be more improved.

[3. Simulation Results]

Figure 5A:
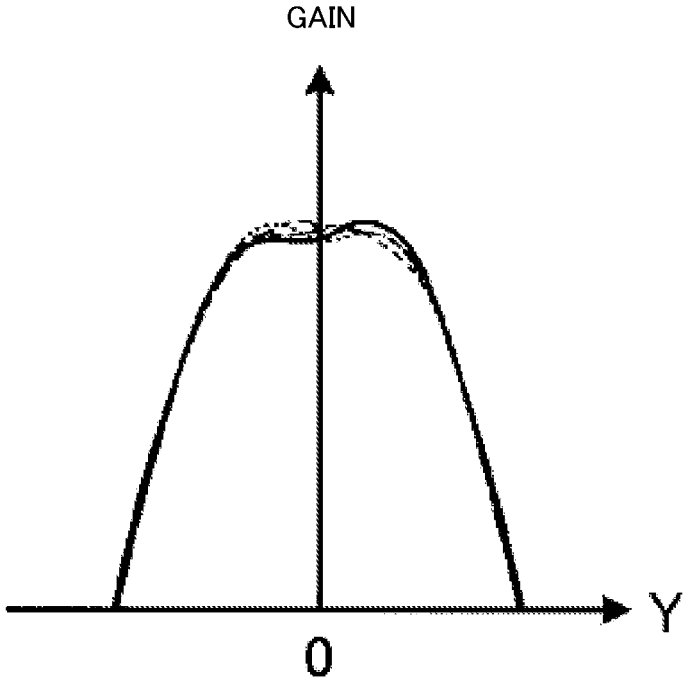
FIG. 5A illustrates results of a simulation using the antenna apparatus.
Figure 5B:
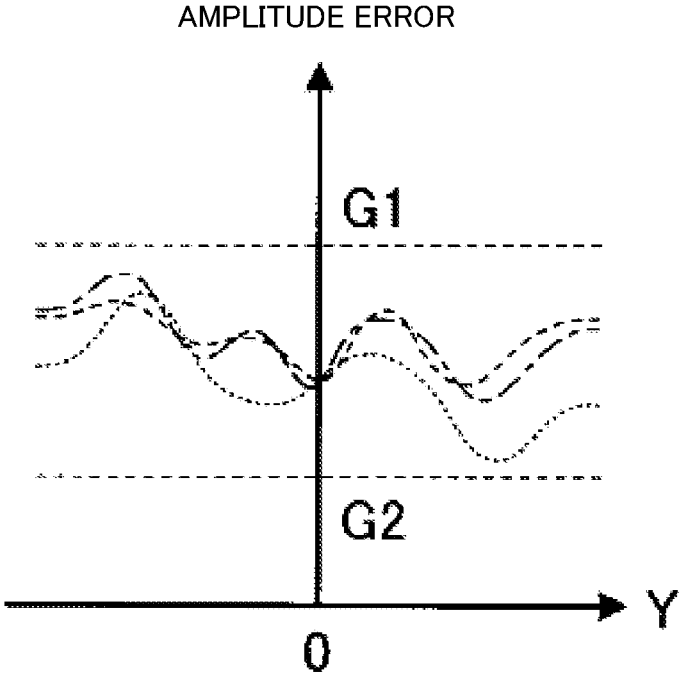
FIG. 5B illustrates results of the simulation using the antenna apparatus.
Figure 5C:
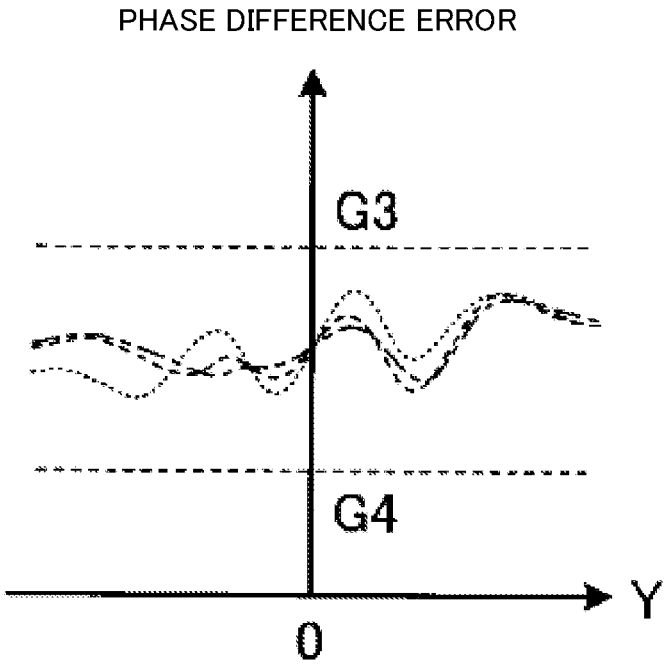
FIG. 5C illustrates results of the simulation using the antenna apparatus.
Figure 6:
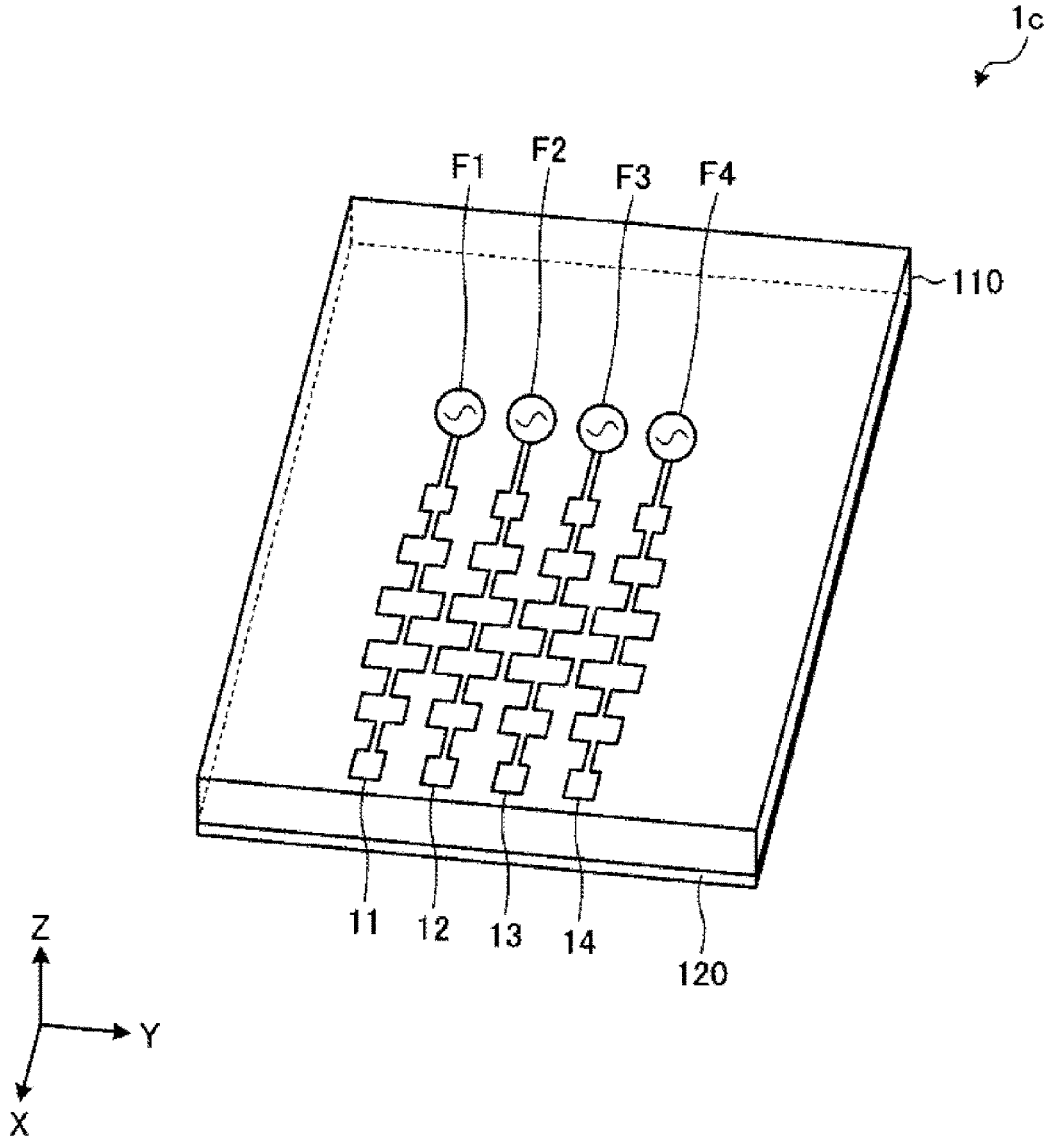
FIG. 6 illustrates a perspective view of an antenna apparatus including no dummy antennas.
Figure 7A:
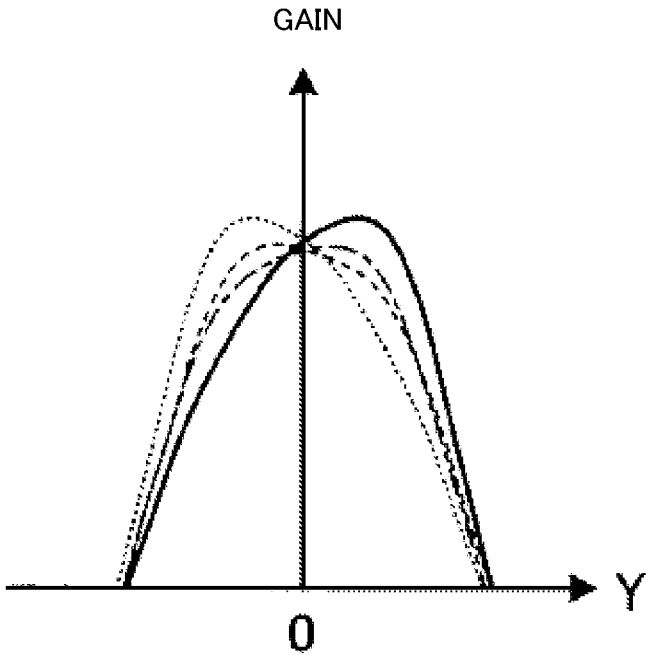
FIG. 7A illustrates results of a simulation using an antenna apparatus.
Figure 7B:
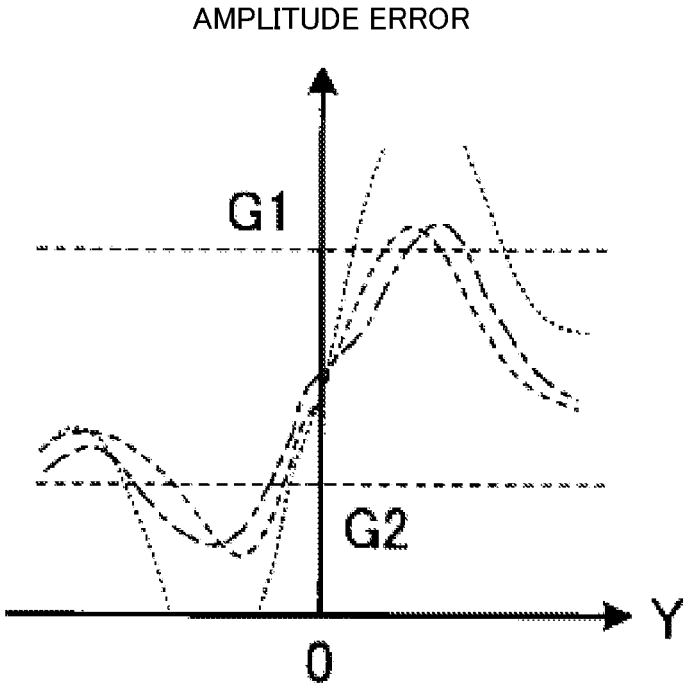
FIG. 7B illustrates results of the simulation using the antenna apparatus.
Figure 7C:
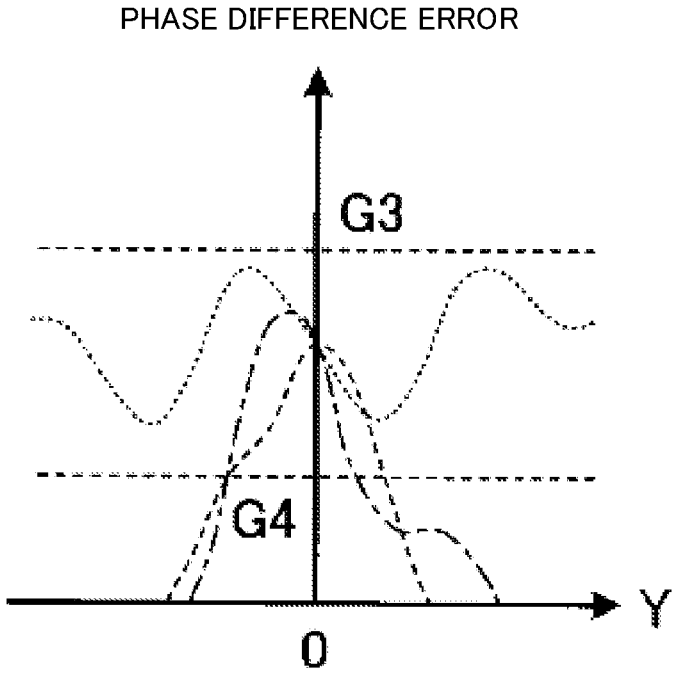
FIG. 7C illustrates results of the simulation using the antenna apparatus.

Next described with reference to FIGS. 5A-7C will be results of a simulation of the antenna apparatus 1 of this embodiment. FIGS. 5A-5C illustrate the results of the simulation using the antenna apparatus 1 of this embodiment. FIG. 6 illustrates a perspective view of an antenna apparatus 1*c* including no dummy antennas 21-24. FIGS. 7A-7C illustrate the results of the simulation using the antenna apparatus 1*c*.

First, the antenna apparatus 1*c* will be described with reference to FIG. 6. The antenna apparatus 1*c* shown in FIG. 6 has a same structure as the structure of the antenna apparatus 1 shown in FIG. 1, except that the antenna apparatus 1*c* includes no dummy antennas 21-24 and no matching elements 211-214. Therefore, same reference numerals given to the elements of the antenna apparatus 1 are given to elements of the antenna apparatus 1*c*.

[Radiation Pattern]

FIG. 5A illustrates the radiation pattern of the antenna apparatus 1. Moreover, FIG. 7A illustrates a radiation pattern of the antenna apparatus 1*c*. In each of FIGS. 5A and 7A, a solid line shows a radiation pattern that is obtained in a case where the power is supplied to the antenna 11; a dashed line shows a radiation pattern that is obtained in a case where the power is supplied to the antennas 12; a dashed-dotted line shows a radiation pattern that is obtained in a case where the power is supplied to the antenna 13; and a dotted line shows a radiation pattern that is obtained in a case where the power is supplied to the antenna 14.

As shown in FIG. 7A, the radiation pattern of the antenna apparatus 1*c* including no dummy antennas 21-24 is greatly tilted in a case where the power is supplied to the antennas 11 and 14. As described above, in a case of the antenna apparatus 1*c*, if the arrangement distance D between the antennas 11-14 is equal to or less than one wavelength of resonance frequency, the radiation pattern is not symmetrical.

On the other hand, as shown in FIG. 5A, even in a case where the power is supplied to any of antennas 11-14, the radiation pattern of the antenna apparatus 1 including the dummy antennas 21-24 is substantially identical to each other, and the symmetry of a radiation pattern of the antenna apparatus 1 can be ensured.

As described above, even in a case where the antennas 11-14 are provided at intervals of a small arrangement distance D, the symmetry of the radiation pattern of the antenna apparatus 1 can be improved by providing the dummy antennas 21-24. Therefore, the distance between the antennas 11-14 of the antenna apparatus 1 can be smaller.

[Amplitude Error]

FIGS. 5B and 7B are graphs showing amplitude errors among the individual antennas 11-14 of the antenna apparatus 1 and the antenna apparatus 1*c*, respectively. Here, the term "amplitude error" means a difference in amplitude values that are obtained, for example, when the antennas have received one same signal. As amplitude errors are smaller, the antennas 11-14 can receive the signal at closer amplitude values. Therefore, the radio device, not illustrated, does not need to adjust the amplitude values, for example, in a signal processing. Thus, a processing load can be reduced.

FIGS. 5B and 7B illustrate the amplitude errors relative to the antenna 11 serving as a reference. In other words, the amplitude errors of the antennas 12-14 are calculated by subtracting the individual amplitude values of the signal received by the antennas 12-14 from an amplitude value of the signal received by the antenna 11.

In each of FIGS. 5B and 7B, a dashed line shows an amplitude error of the antenna 12 relative to the antenna 11; a dashed-dotted line shows an amplitude error of the antenna 13 relative to the antenna 11; and a dotted line shows an amplitude error of the antenna 14 relative to the antenna 11.

As shown in FIG. 5B, in a case of the antenna apparatus 1 including the dummy antennas 21-24, the amplitude errors are within a range from G1 to G2. On the other hand, in a case of the antenna apparatus 1*c* not including the dummy antennas 21-24, the amplitude errors are beyond the range from G1 to G2, as shown in FIG. 7B.

As described above, it is possible to reduce the amplitude errors among the antennas 11-14 of the antenna apparatus 1 by providing the dummy antennas 21-24.

[Phase Difference Error]

FIGS. 5C and 7C are graphs showing errors of phase difference (hereinafter, referred so also as "phase difference errors) among the individual antennas 11-14 of the antenna apparatus 1 and the antenna apparatus 1*c*, respectively. As a direction-of-arrival estimation method of a received signal using, for example, the antenna apparatuses 1 and 1*c*, a method of calculating an arrival direction of a signal based on phase differences of the signal received by the individual antennas 11-14 is known. The phase differences among the antennas 11-14 can be theoretically calculated based on the arrangement distance D between the antennas 11-14.

The term "phase difference error" here means a phase difference between a theoretically-calculated phase difference (hereinafter referred to as "theoretical phase difference value") and a simulated or actually-measured phase difference (hereinafter referred to as "measured phase difference value"). As the phase difference error is smaller, an estimation accuracy of the arrival direction calculated based on the received signal is improved.

FIGS. 5C and 7C illustrate the phase difference errors relative to the antenna 11 serving as a reference. In other words, FIGS. 5C and 7C illustrate the phase difference errors of the antennas 12-14 calculated by subtracting the individual phases of the signal received by the antennas 12-14 from a phase of the signal received by the antenna 11.

In each of FIGS. 5C and 7C, a dashed line shows a phase difference error of the antenna 12 relative to the antenna 11; a dashed-dotted line shows a phase difference error of the antenna 13 relative to the antenna 11; and a dotted line shows a phase difference error of the antenna 14 relative to the antenna 11.

As shown in FIG. 5C, in a case of the antenna apparatus 1, the phase difference errors are within a range from G3 to G4. On the other hand, in a case of the antenna apparatus 1*c*, the phase difference errors are beyond the range from G3 to G4, as shown in FIG. 7C.

As described above, it is possible to reduce the phase difference errors among the antennas 11-14 of the antenna apparatus 1 by providing the dummy antennas 21-24.

As described above, the antenna apparatus 1 of this embodiment includes the dummy antennas 21-24 on the opposite sides of the antenna array 10. Thus, since the radio waves are transmitted also from the dummy antennas 21-24, even if the arrangement distance D between the antennas 11-14 is small, the symmetry of the radiation pattern of the antenna apparatus 1 can be improved. Therefore, the arrangement distance D between the antennas 11-14 can be smaller.

For example, the antenna apparatus 1 is used as a receiving antenna of a radar apparatus. The antenna apparatus 1 of the radar apparatus receives a reflection wave that is a radio wave transmitted by a transmission antenna of the radar apparatus and then reflected by a target. Then, the radar apparatus calculates a distance, a horizontal angle to the target and the like, based on the received signal.

At this time, if the arrangement distance D between the antennas 11-14 of the antenna apparatus 1 is great, a phase return occurs. Therefore, if the arrangement distance D between the antennas 11-14 of the antenna apparatus 1 is great, a range in which the horizontal angle to the target can be uniquely calculated is narrower, or a processing load increases because a process to uniquely decide the target is required. Therefore, it is recommended that the arrangement distance D between the antennas 11-14 should be smaller to widen a detectable range of the horizontal angle while the processing load caused by calculating the horizontal angle is kept low.

The arrangement distance D between the antennas 11-14 can be small in the antenna apparatus 1 of this embodiment by providing the dummy antennas 21-24 while a desired radiation pattern is ensured. Therefore, the antenna apparatus 1 is suitable to a receiving antenna of, for example, a radar apparatus.

[4. Modifications]

The foregoing embodiment has described the case in which the matching elements 211-214 are connected to the dummy antennas 21-24. However, the antenna apparatus 1 is not limited to the structure. Even if the matching elements 211-214 are not provided, i.e., even if one end of each of the dummy antennas 21-24 is unconnected, symmetry of a radiation pattern of an antenna apparatus 2 can be improved by providing the dummy antennas 21-24. This case will be described with reference to FIG. 8.

Figure 8:
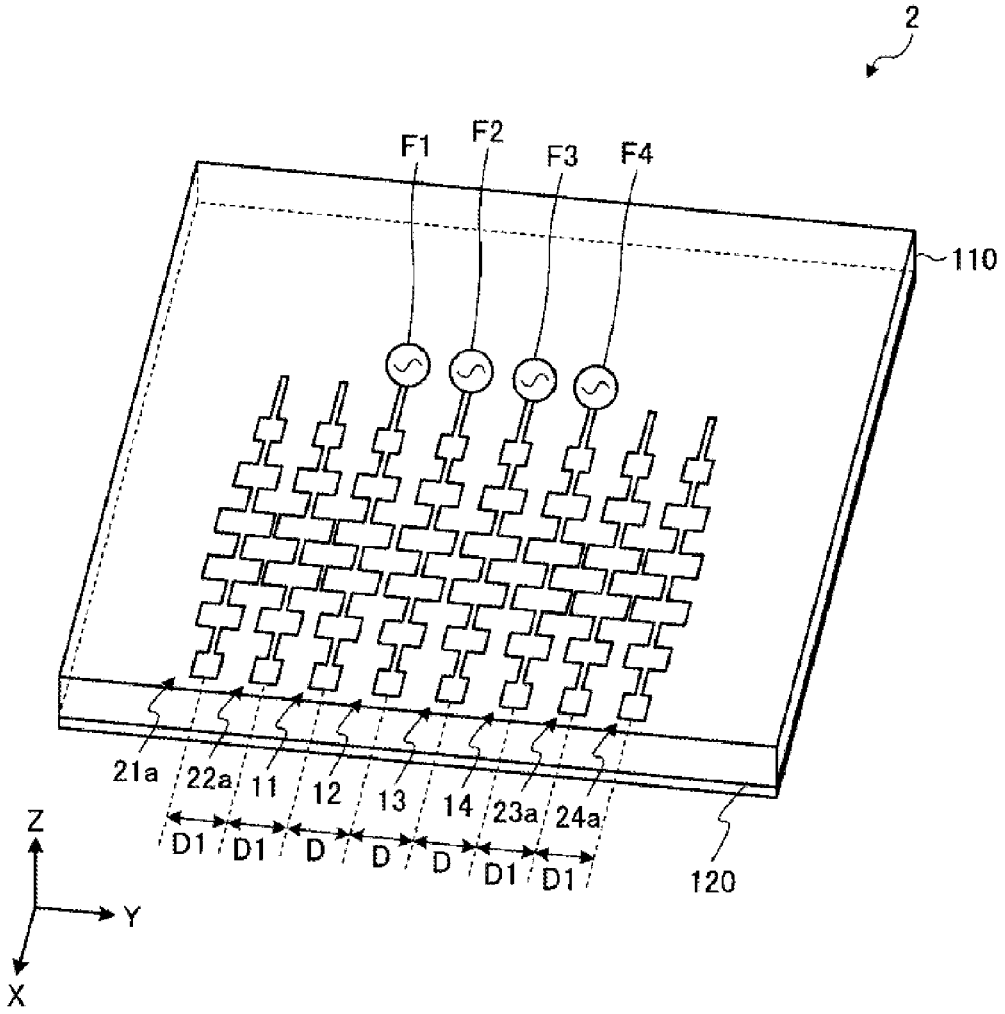
FIG. 8 illustrates a perspective view of an antenna apparatus of a modification.

FIG. 8 illustrates a perspective view of the antenna apparatus 2 of a modification of the embodiment. The antenna apparatus 2 shown in FIG. 8 has a same structure as the antenna apparatus 1 in FIG. 1, except that the antenna apparatus 2 includes no matching elements 211-214. Therefore, same numeral references are given to same elements, and the same elements will not be explained.

As shown in FIG. 8, one end of each of a plurality of dummy antennas 21*a*-24*a* of the antenna apparatus 2 is not connected to the matching elements 211-214, and is open. Even in a case in which the antenna apparatus 2 includes no matching elements 211-214 as illustrated in FIG. 8, symmetry of a radiation pattern of the antenna apparatus 2 can be improved by radio waves transmitted by the dummy antennas 21*a*-24*a*.

However, in a case where the one end of each of the dummy antennas 21*a*-24*a* is unconnected, radiation patterns thereof are different from radiation patterns of a plurality of antennas 11-14. Therefore, there is a possibility that the symmetry of the radiation pattern of the antenna apparatus 2 is not improved as much as the antenna apparatus including the matching elements 211-214.

Therefore, the dummy antennas 21*a*-24*a* of the antenna apparatus 2 of this modification are provided, for example, at intervals of an arrangement distance D1 that is different from an arrangement distance D between the antennas 11-14. FIG. 8 illustrates an example in which the dummy antennas 21*a*-24*a* are provided at intervals of the arrangement distance D1 that is smaller than the arrangement distance D between the antennas 11-14.

As described above, a combining state of the dummy antennas 21*a*-24*a* with the antennas 11-14 can be adjusted by adjusting the arrangement distance D1 between the dummy antennas 21*a*-24*a*. Thus, the radiation patterns of the dummy antennas 21*a*-24*a* can be similar to the radiation patterns of the antennas 11-14. Therefore, the symmetry of the radiation pattern of the antenna apparatus 2 can be improved.

Here, the arrangement distance D1 between the dummy antennas 21*a*-24*a* is smaller than the arrangement distance D between the antennas 11-14. However, a modification is not limited to this. For example, the arrangement distance D1 between the dummy antennas 21*a*-24*a* may be greater than the arrangement distance D between the antennas 11-14.

Moreover, the arrangement distance D1 between the dummy antennas 21*a*-24*a* is adjusted here. However, the arrangement distance D1 is not limited to this. For example, the radiation patterns of the dummy antennas 21*a*-24*a* may be adjusted to be more similar to the radiation patterns of the antennas 11-14 by adjusting a shape of the dummy antennas 21*a*-24*a*.

The shape of the dummy antennas 21*a*-24*a* can be adjusted, for example, by changing a shape or a number of the patch elements 111*a*-116*a* or by changing a length or a shape of the conductor lines 111*b*-116*b*.

As described above, the radiation patterns of the dummy antennas 21*a*-24*a* can be adjusted by adjusting the shape of the dummy antennas 21*a*-24*a*. Thus, the symmetry of the radiation pattern of the antenna apparatus 2 can be improved.

In the foregoing embodiment, the matching elements 211-214 are provided on a same side (the negative X-axis direction) on which the feeding points F1-F4 of the antennas 11-14 are provided. However, the side on which the matching elements 211-214 are provided is not limited to this. For example, the matching elements 211-214 may be provided on a side opposite to the feeding points F1-F4, i.e., the side (the positive X-axis direction) on which ends of the antennas 11-14 are located.

Moreover, in the foregoing embodiment, the matching elements 211-214 are thin-film conductive patterns, like the antennas 11-14 and the dummy antennas 21-24. However, matching elements are not limited to thin-film conductive patterns. The matching elements 211-214 may be any matching elements that generate a load connection state identical to the load connection state of the antennas 11-14. For example, resistor elements may be used.

Moreover, in the foregoing modification, the one end of each of the dummy antennas 21*a*-24*a* is unconnected. However, the end may be shorted to, for example, the ground 120.

Moreover, in the foregoing embodiment and the foregoing modification, the four antennas 11-14, the four dummy antennas 21-24 and the four dummy antennas 21*a*-24*a* are provided. However, numbers of the antennas and dummy antennas are not limited to four. At least one dummy antenna may be provided to each of the opposite sides of the antenna array including the plurality of antennas.

[5. Effect]

The antenna apparatuses 1 and 2 of the foregoing embodiment and the foregoing modification include: the antenna array 10 that includes the plurality of antennas 11-14 arranged next to each other in the predetermined direction (the Y-axis direction); and the plurality of dummy antennas 21-24 or the plurality of dummy antennas 21*a*-24*a* provided on the opposite sides of the antenna array 10.

Thus, the symmetry of the radiation patterns of the antenna apparatuses 1 and 2 can be improved, and the arrangement distance D between the antennas 11-14 can be small.

The antenna apparatus 1 of the foregoing embodiment further includes the plurality of matching elements 211-214 which are connected to ends of the plurality of dummy antennas 21-24, respectively. Thus, the load connection state of the dummy antennas 21-24 is substantially identical to the load connection state of the antennas 11-14. Thus, the symmetry of the radiation pattern of the antenna apparatus 1 can be more improved.

The matching elements 211-214 of the antenna apparatus 1 of the foregoing embodiment have the impedance value substantially identical to the load impedance value of the antennas 11-14. Thus, the load connection state of the dummy antennas 21-24 is substantially identical to the load connection state of the antennas 11-14, and the symmetry of the radiation pattern of the antenna apparatus 1 can be more improved.

In the antenna apparatus 1 of the foregoing embodiment, the direction of the polarized waves in the radiation patterns transmitted from the matching elements 211-214 is orthogonal to the direction of the polarized waves in the radiation patterns transmitted from the antennas 11-14. Thus, an influence of the radio waves transmitted from the matching elements 211-214 on the antennas 11-14 and the dummy antennas 21-24 can be smaller.

The dummy antennas 21-24 of the foregoing embodiment have the shape substantially identical to the shape of the antennas 11-14. Thus, the radiation patterns of the dummy antennas 21-24 can be similar to the radiation patterns of the antennas 11-14. Thus, the symmetry of the radiation pattern of the antenna apparatus 1 can be more improved.

In the antenna apparatus 1 of the foregoing embodiment, a distance (the arrangement distance D) between one of the antennas 11-14 provided at the end of the antenna array 10 and one of the dummy antennas 21-24 that is provided adjacent to the one antenna is substantially identical to the arrangement distance D between the antennas 11-14 of the antenna array 10. Thus, the combined state of the dummy antennas 21-24 is substantially identical to the combined state of the antennas 11-14, and the symmetry of the radiation pattern of the antenna apparatus 1 can be more improved.

One end of each of the dummy antennas 21*a*-24*a* of the foregoing modification is unconnected. As described above, even in the case where the matching elements 211-214 are not provided to the antenna apparatus 1, the symmetry of the radiation pattern of the antenna apparatus 2 can be more improved by providing the dummy antennas 21*a*-24*a*.

One end of each of the dummy antennas 21*a*-24*a* of the foregoing modification is shorted. As described above, even in the case where the matching elements 211-214 are not provided, the symmetry of the radiation pattern of the antenna apparatus 2 can be more improved by providing the dummy antennas 21*a*-24*a*.

The shape of the dummy antennas 21*a*-24*a* of the foregoing modification is different from the shape of the antennas 11-14. As described above, the radiation patterns of the dummy antennas 21*a*-24*a* can be adjusted by making the shape of the dummy antennas 21*a*-24*a* different from the shape of the antennas 11-14, such that the radiation patterns of the dummy antennas 21*a*-24*a* are similar to the radiation patterns of the antennas 11-14.

In the antenna apparatus 2 of the foregoing modification, the distance D1 between one of the antennas 11-14 provided at the end of the antenna array 10 and one of the dummy antennas 21*a*-24*a* that is provided adjacent to the one antenna is different from the arrangement distance D between the antennas 11-14 of the antenna array 10. As described above, the radiation patterns of the dummy antennas 21*a*-24*a* can be adjusted to be similar to the radiation patterns of the antennas 11-14 by causing the arrangement distance D1 between the dummy antennas 21*a*-24*a* to be different from the arrangement distance D between the antennas 11-14.

More effects and modifications of the embodiment can be easily derived by a person skilled in the art. Thus, the specific details and the representative embodiment described above do not intend to limit broader modes of the invention. Therefore, various changes are possible without departing from the comprehensive and conceptive spirit or scope of the invention defined by the attached claims and equivalents thereof.

While the invention has been shown and described in detail, the foregoing description is in all aspects illustrative and not restrictive. It is therefore understood that numerous other modifications and variations can be devised without departing from the scope of the invention.

What is claimed is:

1. An antenna apparatus comprising:

an antenna array that: i) includes a plurality of antennas arranged next to each other in a predetermined direction, ii) is supplied with power from a power source, and iii) transmits radio waves;

a plurality of dummy antennas that: i) are provided on opposite sides of the antenna array in the predetermined direction, ii) are supplied with power from an electric field leaked from the antennas of the antenna array, and iii) transmit radio waves; and a plurality of matching elements each of which is connected to an end of each of the plurality of dummy antennas.

2. The antenna apparatus according to claim 1, wherein an impedance value of each of the matching elements is substantially identical to a load impedance value of each of the antennas of the antenna array.

3. The antenna apparatus according to claim 1, wherein a direction of polarized waves in radiation patterns transmitted from the matching elements is substantially orthogonal to a direction of polarized waves in radiation patterns transmitted from the antennas of the antenna array.

4. The antenna apparatus according to claim 1, wherein a shape of the dummy antennas is substantially identical to a shape of the antennas of the antenna array.

5. The antenna apparatus according to claim 1, wherein a distance between one of the antennas of the antenna array and one of the dummy antennas is substantially identical to an arrangement distance between adjacent ones of the antennas of the antenna array, the one antenna being provided at an end of the antenna array, and the one dummy antenna being provided adjacent to the one antenna provided at the end of the antenna array.

6. The antenna apparatus according to claim 1, wherein one end of each of the dummy antennas is unconnected.

7. The antenna apparatus according to claim 1, wherein one end of each of the dummy antennas is shorted.

8. The antenna apparatus according to claim 1, wherein a shape of the dummy antennas is different from a shape of the antennas of the antenna array.

9. The antenna apparatus according to claim 1, wherein a distance between one of the antennas of the antenna array and one of the dummy antennas is different from an arrangement distance between adjacent ones of the antennas of the antenna array, the one antenna being provided at an end of the antenna array, and the one dummy antenna being provided adjacent to the one antenna provided at the end of the antenna array.

10. The antenna apparatus according to claim 1, wherein each of the matching elements is formed in a substantially rectangular shape having a concavity on one side, and the concavity is connected to a conductor line.

11. The antenna apparatus according to claim 1, wherein the matching elements are provided in a direction that is different from a direction in which the antennas of the antenna array are provided relative to the dummy antennas.

12. The antenna apparatus according to claim 1, wherein each of the dummy antennas includes a plurality of patch elements, the patch elements are connected to one another by a conductor line, and one of the patch elements is connected to one of the matching elements by the conductor line.

13. The antenna apparatus according to claim 12, wherein the conductor line connecting the one patch element to the one matching element is substantially L-shaped.

14. The antenna apparatus according to claim 12, wherein the patch elements are provided axisymmetrically.

15. The antenna apparatus according to claim 12, wherein a first half of the patch elements have widths that decrease as the patch elements are provided closer to the matching element, and a second half of the patch elements have widths that increase as the patch elements are provided closer to the matching element.

16. The antenna apparatus according to claim 12, wherein lengths of the patch elements are substantially identical to each other.

* * * * *